US006640665B1

(12) United States Patent
Williamson

(10) Patent No.: US 6,640,665 B1
(45) Date of Patent: Nov. 4, 2003

(54) CAP REMOVING DEVICE FOR A CONTAINER

(76) Inventor: Yvonne W. Williamson, 1088 Camelot La., Graham, NC (US) 27253

( * ) Notice: Subject to any disclaimer, the term of this patent is extended or adjusted under 35 U.S.C. 154(b) by 0 days.

(21) Appl. No.: 10/068,974

(22) Filed: Feb. 11, 2002

(51) Int. Cl.[7] ..... B67B 7/14
(52) U.S. Cl. ..... 81/3.4; 81/3.09
(58) Field of Search ..... 81/3.4, 3.07, 3.09, 81/3.41

(56) References Cited

U.S. PATENT DOCUMENTS

| | | | | | |
|---|---|---|---|---|---|
| 1,913,906 | A | * | 6/1933 | Swenson | 81/3.4 |
| 1,924,579 | A | * | 8/1933 | Waterhouse | 81/3.4 |
| 1,952,660 | A | * | 3/1934 | Dryden | 81/3.4 |
| 2,003,983 | A | * | 6/1935 | Thener | 81/3.4 |
| 2,015,565 | A | * | 9/1935 | Loeber | 81/3.4 |
| 2,235,313 | A | * | 3/1941 | Cleveland | 81/3.4 |
| 2,475,948 | A | * | 7/1949 | Cox | 81/3.4 |
| 3,999,261 | A | * | 12/1976 | Bingaman | 269/217 |
| 4,001,904 | A | * | 1/1977 | Gill | 7/151 |
| 4,433,597 | A | * | 2/1984 | Rowland | 81/3.09 |
| 4,702,129 | A | * | 10/1987 | Allen | 81/3.09 |
| 4,760,763 | A | * | 8/1988 | Trick et al. | 81/3.09 |
| 4,766,781 | A | * | 8/1988 | Grise et al. | 81/3.4 |
| 5,517,881 | A | * | 5/1996 | Burns | 81/3.4 |
| 5,836,221 | A | * | 11/1998 | Hystead | 81/3.25 |
| 6,205,888 | B1 | * | 3/2001 | Laudani | 81/3.32 |
| 6,415,688 | B1 | * | 7/2002 | Smith | 81/3.4 |

* cited by examiner

*Primary Examiner*—Lee D. Wilson
*Assistant Examiner*—David B. Thomas

(57) ABSTRACT

A cap removing device for a container for easily loosening and removing caps from bottled beverages and jars. The cap removing device for a container includes a flexible member having a wall, a closed end, an open end, a cap-receiving area defined by the wall and being adapted to fit about a cap of a container; and also includes a support member being attached to the flexible member for supporting the flexible member; and further includes a magnetic member being disposed in the support member and being adapted to removably attach to an object such as a refrigerator.

7 Claims, 3 Drawing Sheets

CAP REMOVING DEVICE FOR A CONTAINER

BACKGROUND OF THE INVENTION

1. Field of the Invention

The present invention relates to cap removers and more particularly pertains to a new cap removing device for a container for easily loosening and removing caps from bottled beverages and jars.

2. Description of the Prior Art

The use of cap removers is known in the prior art. More specifically, cap removers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,761,337; U.S. Pat. No. 4,766,781; U.S. Pat. No. 5,022,288; U.S. Pat. No. 4,702,129; U.S. Pat. No. 5,517,881; U.S. Pat. No. Des. 261,854; U.S. Pat. No. 1,952,660; U.S. Pat. No. 4,433,597; and U.S. Pat. No. 466,250.

While these devices fulfill their respective, particular objectives and requirements, the aforementioned patents do not disclose a new cap removing device for a container. The inventive device includes a flexible member having a wall, a closed end, an open end, a cap-receiving area defined by the wall and being adapted to fit about a cap of a container; and also includes a support member being attached to the flexible member for supporting the flexible member; and further includes a magnetic member being disposed in the support member and being adapted to removably attach to an object such as a refrigerator; and allows the user to hang the cap removing device from a suitable object so that it doesn't get lost as would be the case of the cap removing device is placed in a drawer; a feature not described nor suggested by any of the prior art.

In these respects, the cap removing device for a container according to the present invention substantially departs from the conventional concepts and designs of the prior art, and in so doing provides an apparatus primarily developed for the purpose of easily loosening and removing caps from bottled beverages and jars.

SUMMARY OF THE INVENTION

The general purpose of the present invention, which will be described subsequently in greater detail, is to provide a new cap removing device for a container apparatus and method which has many of the advantages of the cap removers mentioned heretofore and many novel features that result in a new cap removing device for a container which is not anticipated, rendered obvious, suggested, or even implied by any of the prior art cap removers, either alone or in any combination thereof.

There has thus been outlined, rather broadly, the more important features of the cap removing device for a container in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new cap removing device for a container apparatus and method which has many of the advantages of the cap removers mentioned heretofore and many novel features that result in a new cap removing device for a container which is not anticipated, rendered obvious, suggested, or even implied by any of the prior art cap removers, either alone or in any combination thereof.

Still another object of the present invention is to provide a new cap removing device for a container for easily loosening and removing caps from bottled beverages and jars.

Still yet another object of the present invention is to provide a new cap removing device for a container that allows the user to conveniently store the cap removing device in a highly accessible location Even still another object of the present invention is to provide a new cap removing device for a container that is easy and convenient to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a partial perspective view of a second embodiment of the magnet of the present invention.

DESCRIPTION OF THE PREFERRED EMBODIMENT

Figure 2:
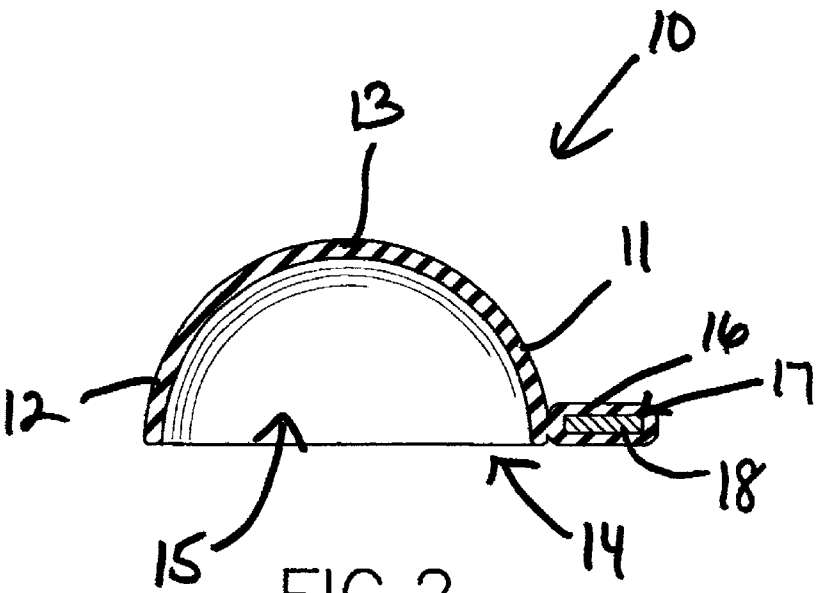
FIG. 2 is a cross-sectional view of the present invention.
Figure 1:
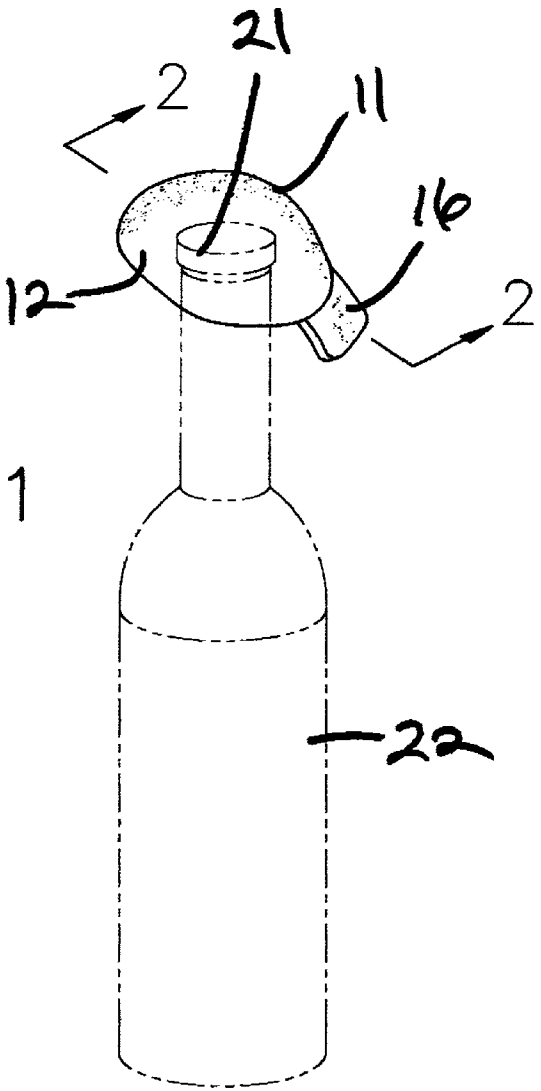
FIG. 1 is a perspective view of a new cap removing device for a container according to the present invention and shown in use.
Figure 3:
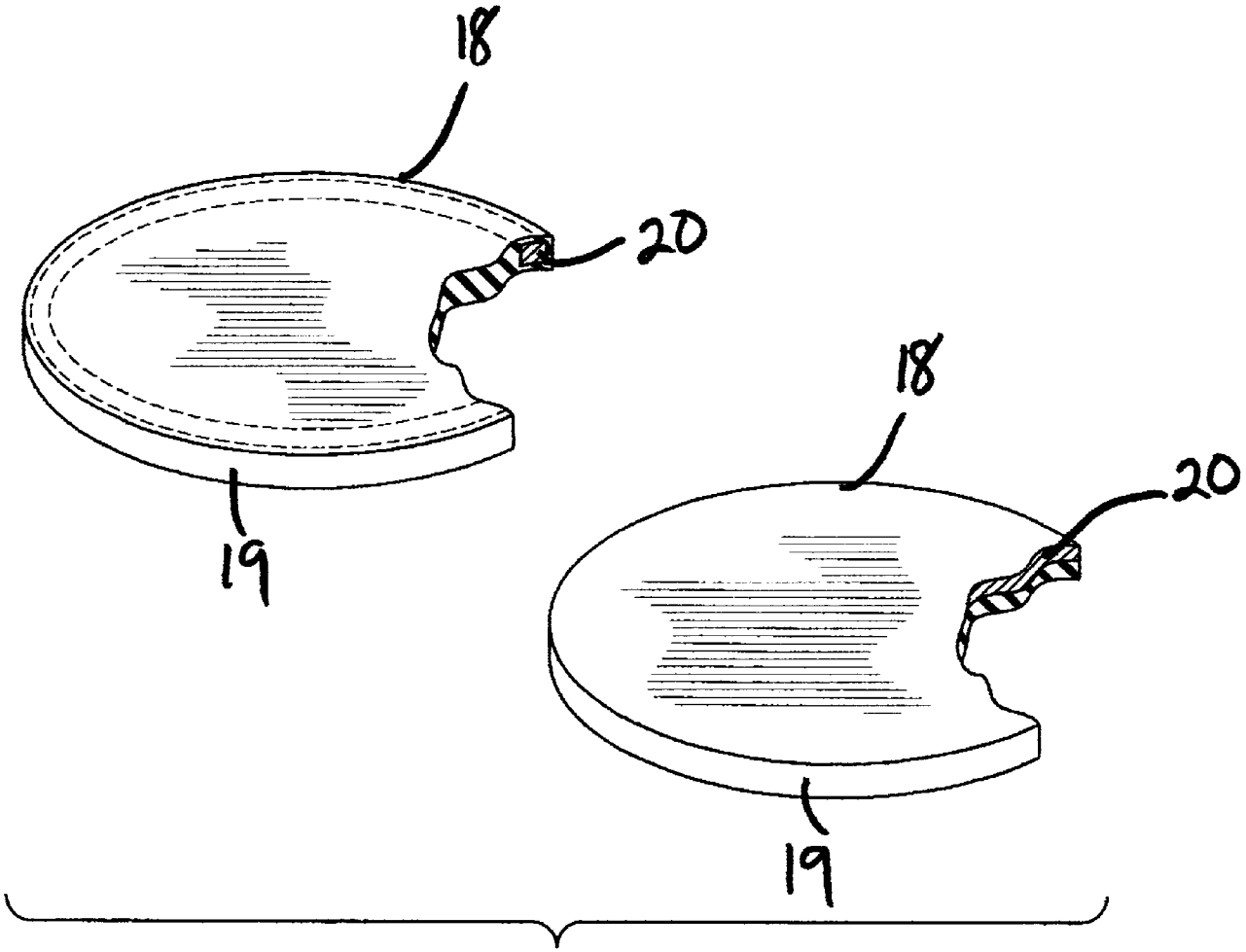
FIG. 3 is a partial perspective view of the magnet of the present invention.
Figure 2:
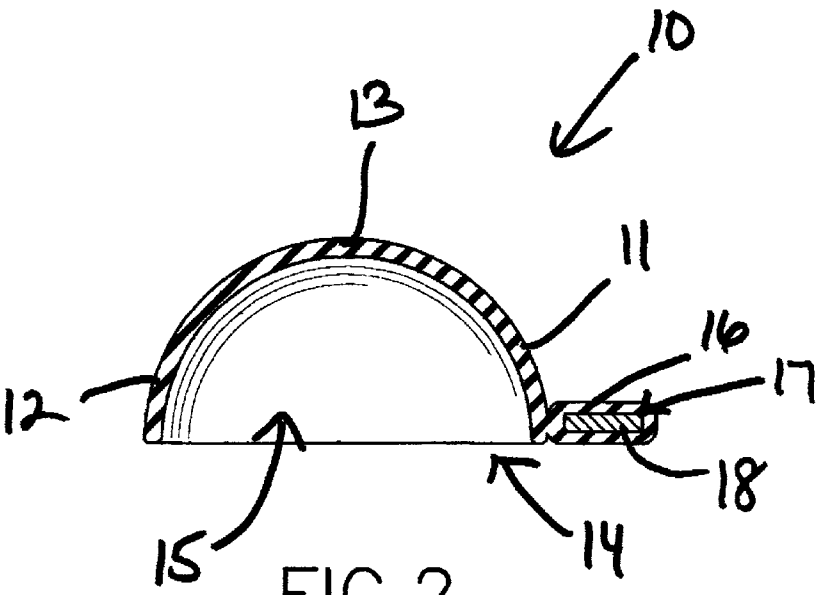
Figure 1:
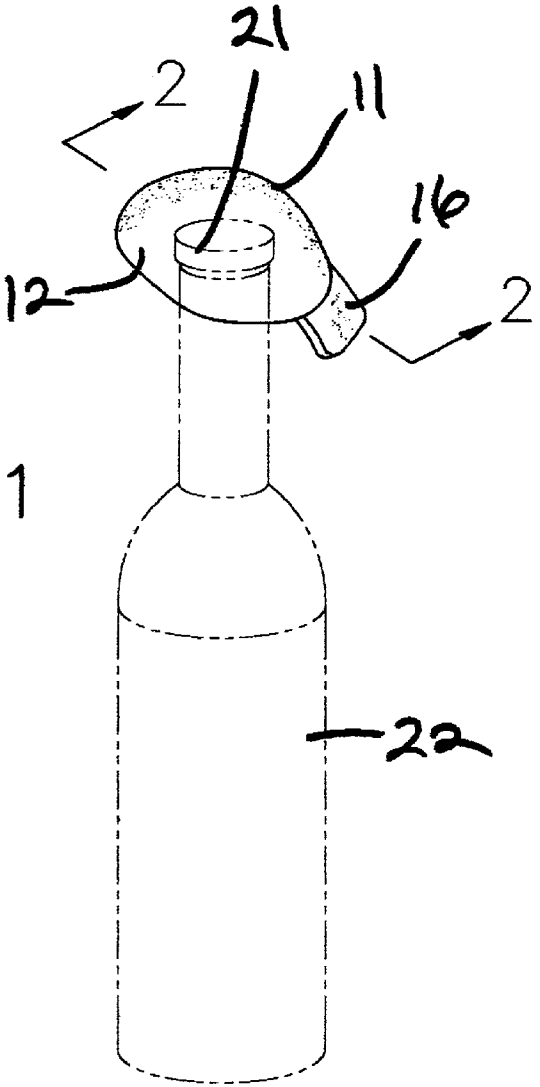

With reference now to the drawings, and in particular to FIGS. 1 through 4 thereof, a new cap removing device for a container embodying the principles and concepts of the present invention and generally designated by the reference numeral 40 will be described.

As best illustrated in FIGS. 1 through 4, the cap removing device for a container 10 generally comprises a flexible member 11 having a wall 12, a closed end 13, an open end 14, a cap-receiving area 15 being defined by the wall 12 and being adapted to fit about a cap 21 of a container 22. The flexible member 11 is generally made of a material conducive for engaging and gripping about a circumference of the cap 21 for a container 22. The flexible member 11 is generally made of a rubberized material. As a first embodiment, the flexible member 11 is disc-shaped. As a second embodiment, the flexible member 11 is conical-shaped.

A support member 16 is conventionally attached to the flexible member 11 for supporting the flexible member 11. The support member 16 is securely and hingedly attached along an edge of the wall 12 at the open end 15 of the flexible member 11. The support member is a flap having an edge being securely and conventionally attached to the flexible member 11. The support member 16 also has an internal cavity 17.

A magnetic member 18 is conventionally disposed in the support member 16 and is adapted to removably attach to an object such as a refrigerator. The magnetic member 18 is disposed in the internal cavity 17 of the support member 16 and is adapted to attach to an object to support the flexible member 11. As a first embodiment, the magnetic member 18 is generally disc-shaped and is made of a rubberized material. As a second embodiment, the magnetic member 18 includes a disc-shaped member 19 and also includes an annular magnet 20 being conventionally disposed in the disc-shaped member 19 and along a perimeter thereof. As a third embodiment, the magnetic member 18 includes a disc-shaped member 19 and also includes a plurality of magnet bars 20 being circumferentially-spaced in the disc-shaped member 19.

In use, the user fits and grasps the flexible member 11 about the cap 21 of the container 22 and turns the flexible member 11 which also turns the cap 21 to remove the cap 21 from the container 22. Without the cap removing device 10, the user would have a much more difficult time removing a cap 21 which slightly threaded or fitted upon the container 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the cap removing device for a container. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cap removing device for a container comprising:

a flexible member having a wall, a closed end, an open end, a cap-receiving area defined by said wall and being adapted to fit about a cap of a container;

a support member being attached to said flexible member for supporting said flexible member, said support member being securely and hingedly attached along an edge of said wall at said open end of said flexible member; and a magnetic member being disposed in said support member and being adapted to removably attach to an object such as a refrigerator.

2. A cap removing device for a container as described in claim 1, wherein said support member is a flap having an edge being securely attached to said flexible member.

3. A cap removing device for a container as described in claim 2, wherein said support member has an internal cavity.

4. A cap removing device for a container as described in claim 3, wherein said magnetic member is disposed in said internal cavity of said support member and is adapted to attach to an object to support said flexible member.

5. A cap removing device for a container as described in claim 4, wherein said magnetic member is generally disc-shaped and is made of a rubberized material.

6. A cap removing device for a container as described in claim 4, wherein said magnetic member includes a disc-shaped member and also includes an annular magnet being disposed in said disc-shaped member and along a perimeter thereof.

7. A cap removing device for a container as described in claim 4, wherein said magnetic member includes a disc-shaped member and also includes a plurality of magnet bars being circumferentially-spaced in said disc-shaped member.

* * * * *